United States Patent [19]

Pfotenhauer

[11] 3,963,017

[45] June 15, 1976

[54] MANUALLY COCKING SPRING-POWERED PROJECTILE LAUNCHER

[76] Inventor: James M. Pfotenhauer, 1302 N. 19th St., Escanaba, Mich. 49829

[22] Filed: Jan. 6, 1975

[21] Appl. No.: 538,801

[52] U.S. Cl. ..... 124/21; 124/80; 273/106.5 C; 124/22; 124/40; 124/41 R

[51] Int. Cl.[2] ..... F41B 7/00

[58] Field of Search ..... 124/22, 21, 37, 41 R, 124/27, 30 R

[56] References Cited

UNITED STATES PATENTS

| | | | |
|---|---|---|---|
| 310,873 | 1/1885 | Bradley | 124/21 |
| 408,062 | 7/1889 | Adams | 124/22 |
| 1,571,643 | 2/1926 | Renick | 124/21 |
| 2,053,152 | 9/1936 | Kiesel | 124/27 |
| 2,760,480 | 8/1956 | Carroll | 124/22 |
| 3,415,239 | 12/1968 | Swett | 124/22 X |
| 3,476,100 | 11/1969 | Carbonneau | 124/41 R X |

FOREIGN PATENTS OR APPLICATIONS

| | | | |
|---|---|---|---|
| 13,263 | 1890 | United Kingdom | 124/21 |

*Primary Examiner*—Richard C. Pinkham
*Assistant Examiner*—William R. Browne
*Attorney, Agent, or Firm*—Burns, Doane, Swecker & Mathis

[57] ABSTRACT

A projectile launcher includes a housing formed of releasably secured longitudinal sections. The housing defines a bore extending fore-to-aft and including a spring-carrying compartment and a projectile discharge channel. A spring tube is anchored adjacent the forward end of the bore and extends rearwardly within the bore over a reaction guide pulley. A plunger is slidably disposed within the bore and includes a projectile impact portion slidably disposed within the projectile discharge channel. A cord is fastened at one end to the spring tube and at its other end to the plunger. A cocking aperture is provided in the plunger and is operable to receive a removable cocking bar. Rearward movement of the cocking bar when disposed within the cocking aperture causes the plunger to expand the spring in an energy-storing manner. A trigger mechanism is provided at the rear of the housing to retain the plunger and the spring tube in a cocked position. Activation of the trigger enables the spring tube to propel the plunger forwardly within the bore to advance and discharge a projectile located in the projectile discharge channel ahead of the plunger. The reaction pulley is disposed intermediate the ends of the spring tube and is arranged to contract when the trigger mechanism releases the plunger from a cocked position to propel the plunger forwardly, together with a projectile located ahead of the plunger and is also arranged to bend around the reaction guide pulley during forward travel of the plunger to exert rearward forces on the plunger to gradually brake the speed of the plunger.

5 Claims, 7 Drawing Figures

MANUALLY COCKING SPRING-POWERED PROJECTILE LAUNCHER

BACKGROUND AND OBJECTS OF THE INVENTION

The present invention relates to a projectile launcher and, more specifically, to a manually cocked, spring-powered gun capable of shooting darts, steel balls, and other projectiles.

Guns of the manual cocking, spring-powered type are well known as exemplified in U.S. Pat. Nos. 220,325; 1,261,992; 1,287,401; 1,353,663; and 1,683,574. Typically, such guns include a housing carrying a power spring of some sort. The spring is capable of being shifted to a cocked position and held therein by a trigger mechanism. A projectile is positioned within a firing channel so that when the trigger is activated, stored energy from the spring is transferred to the projectile to accelerate and launch the latter.

Guns of this type should provide ample fire power without being unduly difficult to cock or control upon firing. In some instances, relatively weak springs are employed that are easily tensioned. However, these springs may not provide sufficient fire power.

The gun should also be relatively light and compact so as to facilitate handling. In addition, power transfer from the power spring to the projectile should be smooth and uniform, without producing significant jerking during firing. The power spring should be capable of relatively unobstructed expansion and contraction to minimize wear thereof.

It is, therefore, an object of the present invention to provide a manually cocked, spring-powered gun which exhibits these and other advantageous features.

More particularly, it is an object of the invention to provide such a gun which achieves maximum fire power while being easy to handle, cock, and fire.

Another object is to provide such a gun which is capable of employing a relatively powerful spring and spring-powered plunger that is braked to a halt in a relatively gradual manner.

It is another object of the invention to effect, in such a gun, a transfer of power from the spring to a projectile in an efficient manner which reduces the likelihood of misfire and which minimizes wear of the spring.

It is yet a further object of the invention to provide such a gun which is essentially inexpensive, uncomplicated, and whose vital parts are protectively enclosed.

It is another object of the invention to provide such a gun which utilizes a pulley for effecting a gradual braking of a manually cockable projectile-launching plunger.

It is still a further object of the invention which fires easily transportable ammunition in a manner producing significant penetration and kill power.

It is a further object of the invention to provide such a gun which is capable of firing a steel ball or a plurality of steel balls in the manner of a shotgun.

BRIEF SUMMARY OF A PREFERRED EMBODIMENT OF THE INVENTION

These advantages are achieved by the present invention wherein a spring-powered projectile launcher comprises a housing which includes a bore having a discharge opening at the front of the housing. An impact plunger is slidably mounted in the bore and is arranged to be connected to a cocking lever. A trigger mechanism is provided for retaining the plunger in a cocked position and releasing the plunger for forward firing movement. A power spring is disposed in the bore and is operably connected at one end to the housing and operably connected at its other end to the plunger. The power spring is disposed such that the rearward movement of the plunger to a cocked position causes the spring to be expanded in an energy-storing manner to bias the plunger forwardly. A reaction guide is mounted in the bore at a location intermediate the ends of the spring when the spring is in an expanded posture. The spring is arranged to contract when the trigger mechanism releases the plunger from a cocked position to propel the plunger forwardly and launch a projectile located ahead of the plunger. The spring is further arranged to bend around the reaction guide during forward travel of the plunger to exert rearward braking forces on the plunger to gradually brake the speed of the plunger.

THE DRAWING

Other objects and advantages of the present invention will become apparent from the subsequent detailed description thereof in connection with the accompanying drawing in which like numerals designate like elements and in which.

DETAILED DESCRIPTION OF THE PREFERRED EMBODIMENT

Figure 1:
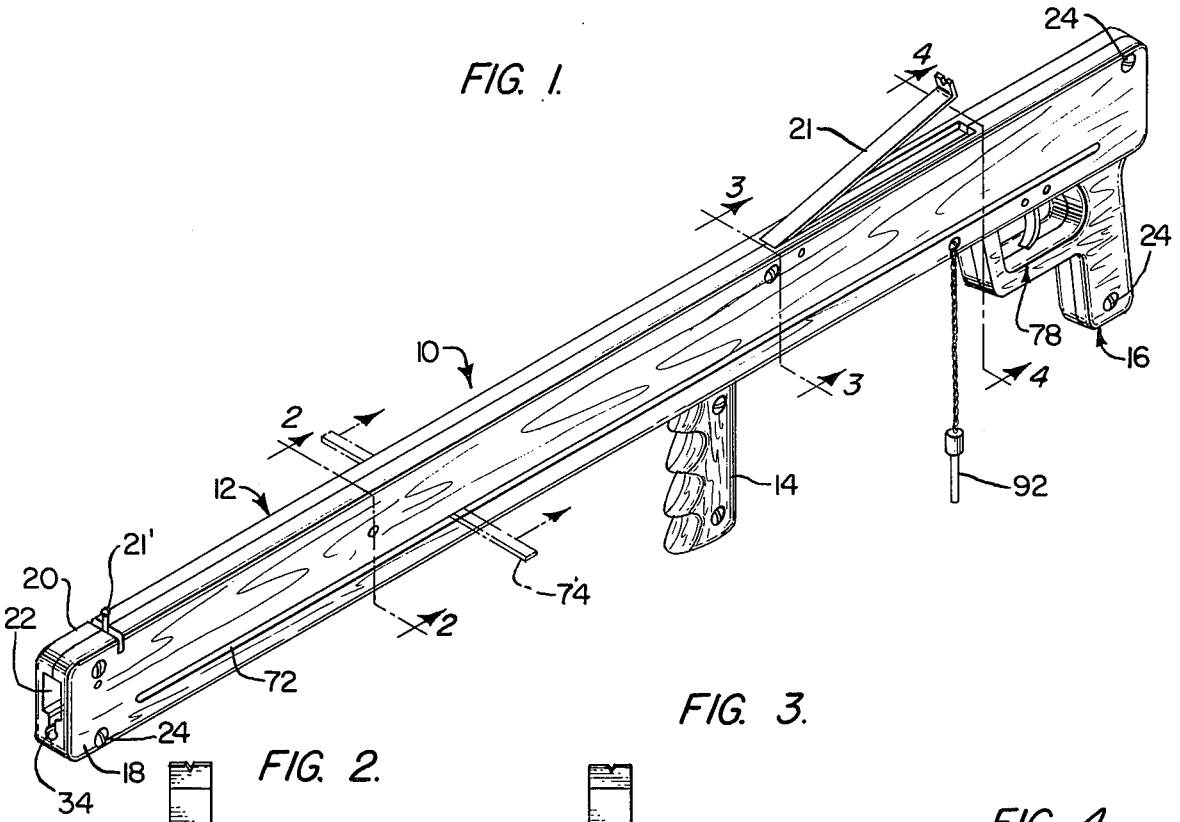
FIG. 1 is a perspective view of a dart gun embodying the principles of the present invention.
Figure 2:
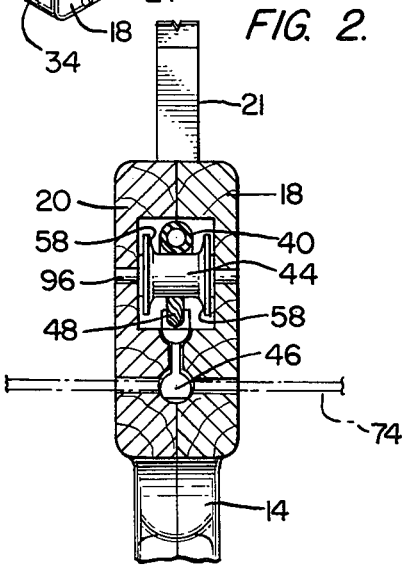
FIG. 2 is a transverse sectional view of the gun taken along line 2—2 of FIG. 1.

A dart gun 10 shown in FIGS. 1 through 7 embodies the principle features of the present invention. The gun 10 comprises a housing 12 which includes a front hand grip 14, and a rear hand grip 16.

The housing comprises a pair of longitudinal sections 18, 20. Within the housing there is disposed a longitudinal bore 22 which is defined by mating recessed portions of the housing sections 18, 20. The housing sections are separably coupled by means of removable fasteners, such as screws 24.

The housing may be fabricated of metal, wood, plastic, or any suitable, lightweight material. A visual sight 21 may be pivoted to the housing so as to be shiftable from a retracted posture to an upright posture. A sight pin 21′ is mounted at the forward end of the housing to cooperate with the sight 21 in lining-up a target. The sight pin 21′ can be given a slight degree of frictional sliding movement from side to side to adjust for windage. The sight 21 can be provided with a vertically slidable peep hole for elevational adjustment.

Figure 3:
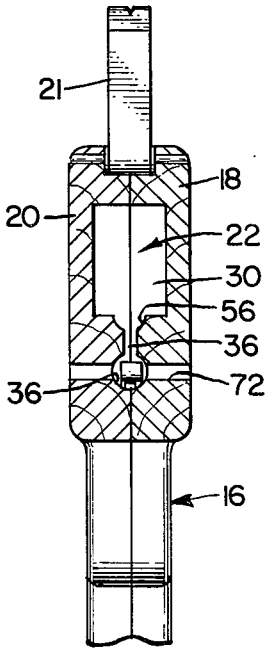
FIG. 3 is a transverse sectional view of the gun taken along line 3—3 of FIG. 1.
Figure 4:
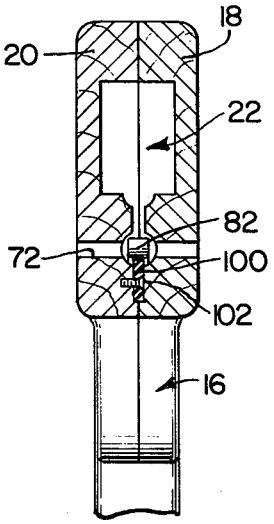
FIG. 4 is a transverse sectional view of the gun taken along line 4—4 of FIG. 1.
Figure 5:
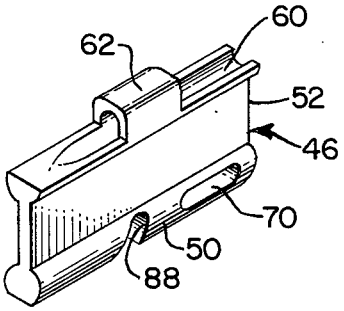
FIG. 5 is a perspective view of an impact plunger component of the gun.

The bore 22 comprises a spring-carrying compartment 30 and a projectile discharge channel 32 (FIG. 3). Preferably, the projectile discharge channel 32 is circular in shape and terminates in a projectile discharge opening 34 at the front end of the housing. It will be appreciated, of course, that the projectile discharge channel 32 can be configured in any desired manner to accommodate projectiles of varying configurations. The spring-carrying compartment 30 is disposed above the projectile discharge channel 32 and communicates therewith via a connecting slot porton 36 of the bore 22.

Figure 6:
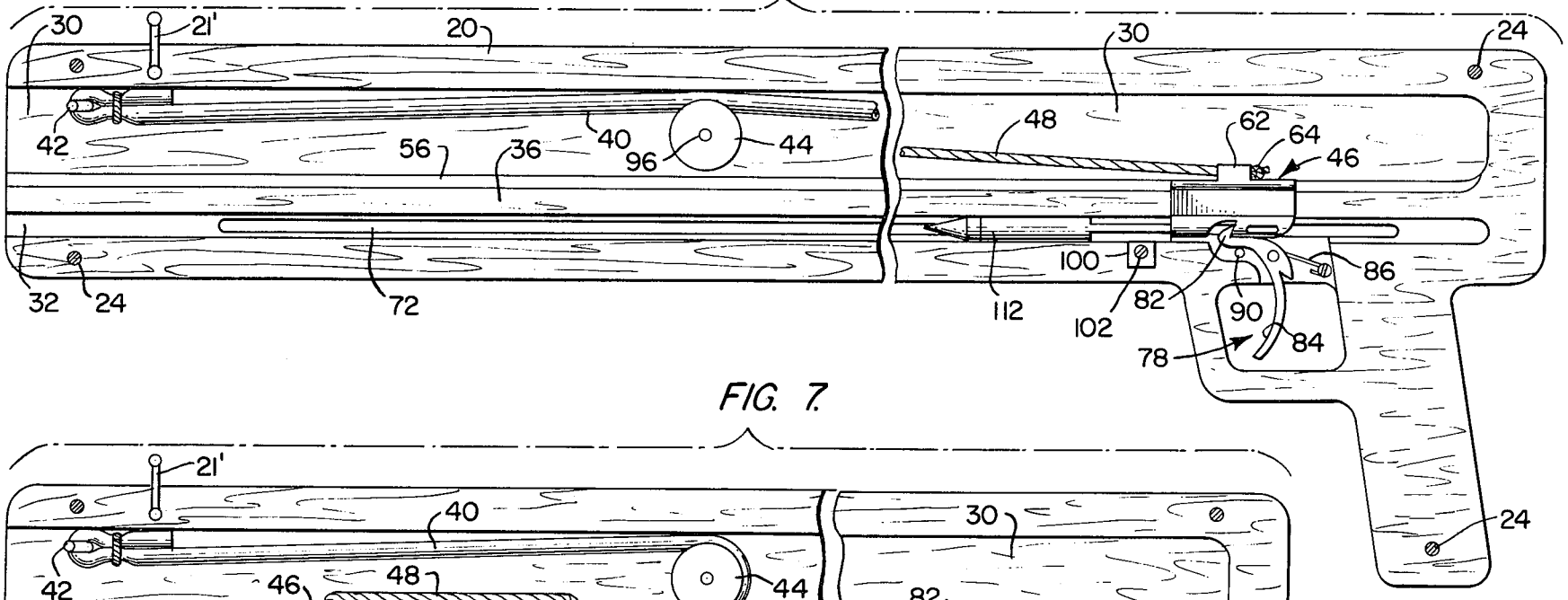
FIG. 6 is a side elevational view of the gun with one of its longitudinal sections removed and depicting the gun in a cocked condition ready to fire.

Anchored within the compartment 30 is a power spring, best shown in FIGS. 6 nd 7. While the power spring may take various forms of expandible and retractable elastic elements, it is preferable that an elastic tube 40, such as rubber surgical hose for example, be utilized. At its forward end the rubber hose is suitably anchored to a bracket 42 by being tied therearound.

The tube 40 extends over a reaction guide pulley 44, the character and function of which will be subsequently set forth in detail. The rear spring end is fastened to an impact plunger 46 which is slidably disposed within the bore 22. While such a connection may be made directly, it is preferable to employ a cord 48 that is tied between the tube and the impact plunger 46. The impact plunger includes a projectile impact portion 50 which slides within the projectile discharge channel 32, an intermediate web portion 52 which slides within the slot 36, and a spring connect portion 54 that slides within a groove 56 disposed at the bottom of the compartment 30.

A groove 60 is provided at the top of the spring connect portion, and a bridge element 62 extends thereacross. In order to connect the cord 48 to the plunger, the cord is positioned through the bridge element 62 and is knotted at its free end 64. In this fashion, a force-transmitting connection between the spring tube 40 and the impact plunger is effected.

Extending through the impact plunger 46 is a cocking aperture 70. This aperture 70 is aligned with transverse slots 72 (FIGS. 1, 3, 4) that are formed at opposite sides of the projectile discharge channel 32. The arrangement is such that a cocking lever, such as a metal rod 74 (see phantom lines, FIGS. 1 and 2), may be inserted into the cocking aperture and pulled rearwardly. Rearward movement of the impact plunger causes the spring tube 40 to be tensioned toward a cocked condition.

Figure 7:
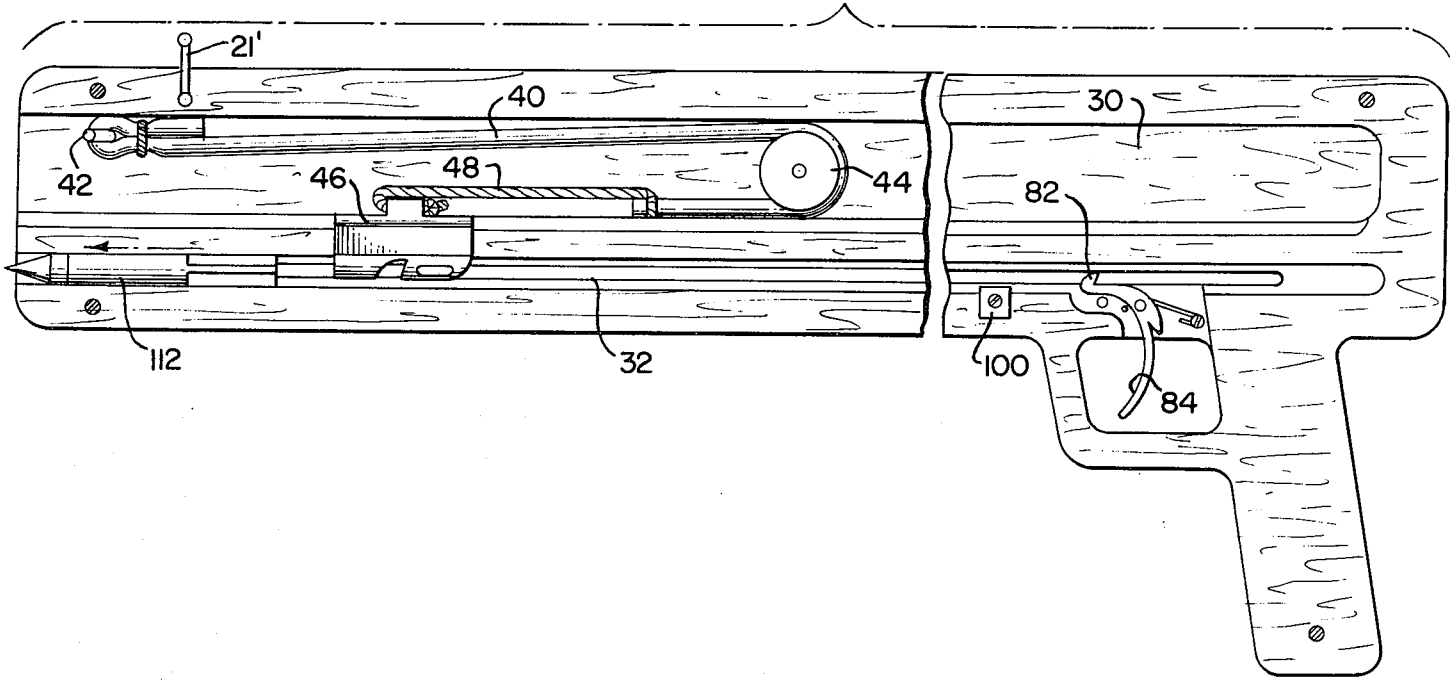
FIG. 7 is a view similar to FIG. 6 depicting the gun components subsequent to activation of the trigger.

In order to hold the impact plunger and the spring tube 40 in a cocked position, a trigger mechanism 78 is provided (FIGS. 6 and 7). The trigger mechanism includes a pivotal trigger 80 having a latching leg 82 and a manual-actuating arm 84. The trigger 80 is biased by a spring 86 to a position wherein the latching leg 82 engages a notch 88 in the impact portion 50 of the plunger 46. By virtue of this arrangement, when the impact plunger 46 is retracted until the notch 88 overlies the latching leg 82, the latching leg shifts into engagement with the notch to hold the plunger 46 in a cocked position. This condition is shown in FIG. 6 wherein the cord 48 is tautly connected between the tensioned tube 40 and the plunger 46 to exert forward biasing forces on the plunger.

A safety opening 90 is disposed below the latching leg 82 and is operable to receive a safety pin 92, chained to the housing (FIG. 1), to prevent accidental activational movement of the trigger when the spring tube 40 and the plunger 46 are retained in a cocked condition.

The reaction guide pulley 44 is disposed in the compartment 30 intermediate the ends of the spring tube 40. The pulley is freely rotatably mounted on a bearing pin 96 so as to facilitate expansion and contraction of the spring tube in a friction-reducing manner. At its sides, the reaction guide pulley 44 includes flanges 98 which retain and guide the spring tube. Preferably, the pulley 44 is fabricated of magnesium, but other lightweight friction-reducing materials can be used.

With the spring tube 40 in a cocked position, it rests on the pulley 44. When the trigger is actuated to release the spring tube 40, the spring tube 40 contracts rapidly, thereby pulling the impact plunger 46 forwardly with substantial force. Any projectile or projectiles that are disposed ahead of the plunger 46 are propelled forwardly through and from the channel 32.

During its contraction, the spring tube is guided by the freely rotating pulley 44. Once the plunger 46 reaches and begins to advance forwardly beyond the pulley 44, under its spring-induced momentum, forward movement of the plunger is resisted by the spring tube 40, the latter being caused to re-expand under the urgings of the plunger (FIG. 7). As the spring tube 40 re-expands, it bends around the pulley 44 and applies gradually increasing braking forces to the plunger 46. Consequently, the plunger is progressively, smoothly braked to a halt within the bore 22.

The pulley 44 is positioned sufficiently near the forward end of the housing 12 so as to allow a substantial portion of the energy stored by the cocked spring tube 40 to be transmitted to the plunger, and sufficiently remote from the forward end of the housing to assure that the plunger 46 does not pass from the bore 22. Thus, the projectile is launched at high speed, but the plunger remains safely within the housing. Moreover, there is little forward kicking or jerking of the gun as might occur if a plunger were caused to stop by impacting against a stop surface.

It will be understood that the relative positions of the compartment 30 and the channel 32 could be reversed, with the spring tube being located below the plunger. In such a case, the spring tube would pass around the pulley at the lower side thereof, which would still be its outer side relative to the channel 32.

In the event that the gun is to be utilized to fire steel balls and the like, the gun may include a projectile retainer strip 100 mounted ahead of the trigger (FIGS. 6 and 7). This retainer strip 100 is formed of a resilient material, preferably rubber, and is secured by means of a screw 102. The strip 100 is arranged such that the upper portion thereof projects slightly into the projectile discharge channel 32. Consequently, a projectile such as a steel ball which is located behind or atop the strip will be confined within the channel 32. Therefore, even if the gun is tilted downwardly while loaded, accidental loss of the steel ball will be resisted. Additional retainer strips may be spaced ahead if desired for retaining darts or several balls for the purpose of multiple firing.

OPERATION

In order to cock the gun, the removable cocking lever 74 is inserted into the cocking aperture 70 of the impact plunger and is drawn rearwardly by the operator. This action causes the spring tube 40 to expand. When the impact plunger engages the latching leg 82, a camming surface 110 of the plunger depresses the leg 82 and the plunger further retracts until the notch 88 overlies the leg 82. The leg 82 then snaps upwardly into the notch 88 to hold the plunger 46 in a cocked posture. The spring tube 40 is held in an extended, energy-storing condition. A projectile, such as a dart 112, is inserted into the front end of the discharge channel 32. Subsequent upward tilting of the gun causes the dart to slide rearwardly to a position in which it abuts or almost abuts the impulse slide (FIG. 6). The rearward end of the dart can include fins which enable the dart to straddle the strip 100, should the latter be employed. If desired, a ramming rod may be utilized to push the projectile rearwardly within the channel 32.

In any event, the dart 112 is disposed within the channel 32. Subsequent activation of the trigger releases the spring tube 40. Resultant contraction of the spring tube 40 along the pulley 44 causes the impact plunger to be pulled forwardly at high speed. The dart 112 is thus accelerated toward the discharge opening 34. As the impact plunger advances beyond the reaction pulley 44, the spring tube 40 re-expands, and gradually brakes the plunger to a halt. By this time, a substantial part of the stored spring energy has been transferred to the dart to discharge the latter at high speed.

If it is desired to fire steel balls or the like from the gun, one or more such steel balls can be inserted into the channel 32 with the gun being then activated as discussed previously. Advantage of the projectile retainer strip 100 can be taken in this case by pushing the ball or balls between the strip and the plunger. The strip 100 thus confines the ball within the bore 22 until the trigger is activated. The strip 100 is sufficiently resiliently depressible to present no significant obstruction to plunger movement.

The cocking rod 74 may be carried by an operator between cocking operations, or it may be stored within a suitable chamber provided in the gun housing.

SUMMARY OF MAJOR ADVANTAGES AND SCOPE OF THE INVENTION

The arrangement of the spring tube and the reaction pulley enables the spring to brake the plunger in a highly efficient and compact manner. The effective energy-storing length of the spring extends from its anchor point to its free end (FIG. 6), whereas the effective braking length of the spring can be considered to extend from the reaction pulley to the free end of the spring (FIG. 7). Thus, maximum distance is established for storing energy and minimum distance is required for braking the plunger. Consequently, high fire power can be achieved within a relatively compact gun.

The relatively smooth, gradual braking action which is applied to the pulley during firing prevents jerking of the gun and danger of damage to gun components. The arrangement whereby the plunger is retained within the housing during firing adds significant safety to gun operation.

The rotatable reaction pulley serves to guide the power spring during expansion and contraction thereof, tending to minimize the danger of the spring becoming disoriented and jammed within the bore.

By providing a locking lever which extends outwardly of both sides of the gun, the gun can be cocked with both hands. This enables rubber tubing of relatively large force to be employed.

The gun is capable of firing darts, or steel balls, making it highly versatile as compared with other forms of weapons, such as a cross-bow.

The impact plunger serves as an effective means of transferring power from the spring to a projectile as well as an instrument for holding the spring in a cocked posture.

The few components required by the efficient arrangement of the present invention reduces the chances of malfunction occurring. Moreover, the components are protectively enclosed within the housing sections, yet are conveniently exposed for maintenance by the release of a few fasteners. By providing efficient and powerful operation with few components, the gun is inexpensive and uncomplicated to operate.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A projectile launcher comprising:

a housing means for forming a barrel and at least one hand grip;

said housing means including a pair of longitudinal sections secured together by releasable fasteners;

each of said sections being recessed so as to define an inner bore when said sections are secured together;

said bore including a compartment, a projectile launching channel, and a slot portion communicating said launching channel with said compartment;

an elongate cocking bar;

an impact plunger having a projectile discharge portion slidably disposed in said channel and having forward and rearward ends;

said discharge portion including a trigger engaging portion at the bottom thereof;

said plunger including a cocking aperture located in a rear portion thereof and being aligned with slots in said housing sections to removably receive said cocking bar completely through said aperture and slots so as to be grippable by both hands of an operator;

said cocking bar, when drawn rearwardly, being operable to shift said plunger rearwardly toward a cocked position;

said plunger including a web portion extending upwardly from said discharge portion and being slidable in said slot portion of said bore, said discharge portion being of greater thickness than said slot portion to retain said discharge portion in said channel;

an elongate, flexible spring element disposed in said compartment;

one end of said spring element being anchored at a point near the front end of said housing;

the other end of said spring element being operably connected to said web portion so that rearward movement of said plunger toward a cocked position tensions said spring;

trigger means at the rear of said housing for engaging said trigger engaging portion and latching said plunger and said spring element in a cocked condition;

said trigger means being operable to unlatch said plunger to allow said spring element to propel said plunger forwardly; and a freely rotatable pulley located in said compartment above said launching channel and intermediate the ends of said spring when said spring is tensioned;

said spring passing around and being in contact with said pulley when in a tensioned condition so as to be guided thereby;

said front anchoring point of said spring being disposed above the point of operable connection between said spring and said web portion so that said spring, in a tensioned condition, is inclined so as to apply an upwardly and forwardly directed force to said plunger;

said point of operable connection between said spring and said web portion being spaced from said front and rear ends of said plunger.

2. A projectile launcher according to claim 1 wherein said spring attachment portion of said plunger comprises; a cord; an opening extending parallel to the fore-aft direction of said channel through which opening extends said cord; one end of said cord being fastened to said spring, the other end of said cord being knotted behind said opening to couple said spring to said plunger; said opening being spaced from said forward and rearward ends of said plunger.

3. A projectile launcher according to claim 2 wherein said spring means comprises a resilient tube; and said cocking aperture is disposed rearwardly of said trigger engaging portion.

4. A projectile launcher according to claim 3 including at least one strip of resilient material projecting upwardly into said launching channel head of said trigger means to retain projectiles within said launching channel.

5. A projectile launcher according to claim 13 wherein said tube passes around an outer side of said pulley so that when a cocked plunger is released, said spring (1) contracts to forwardly propel said plunger, and (2) re-expands around said pulley when said plunger advances beyond said pulley, so as to apply braking forces to said plunger and gradually brake said plunger to a halt.

* * * * *